US008382926B2

(12) United States Patent
Groten et al.

(10) Patent No.: US 8,382,926 B2
(45) Date of Patent: Feb. 26, 2013

(54) TEAR PROPAGATION-RESISTANT TEXTILE SHEET MATERIAL, METHOD MAKING AND USE THEREOF

(75) Inventors: Robert Groten, Sundhoffen (FR); Ulrich Jahn, Labaroche (FR); Georges Riboulet, Colmar (FR); Michael Hess, Trippstadt (DE); Ameur Abdelkader, Colmar (FR)

(73) Assignee: Carl Freudenberg KG, Weinheim (DE)

( * ) Notice: Subject to any disclaimer, the term of this patent is extended or adjusted under 35 U.S.C. 154(b) by 205 days.

(21) Appl. No.: 12/675,615

(22) PCT Filed: Jul. 2, 2008

(86) PCT No.: PCT/EP2008/005391

§ 371 (c)(1),
(2), (4) Date: Feb. 26, 2010

(87) PCT Pub. No.: WO2009/030300

PCT Pub. Date: Mar. 12, 2009

(65) Prior Publication Data

US 2010/0209684 A1 Aug. 19, 2010

(30) Foreign Application Priority Data

Aug. 28, 2007 (DE) ..... 10 2007 040 795

(51) Int. Cl.
*B32B 37/00* (2006.01)

(52) U.S. Cl. ..... 156/148; 156/62.6; 156/167

(58) Field of Classification Search ..... 156/148, 156/62.2, 62.4, 296, 308.2, 167, 181
See application file for complete search history.

(56) References Cited

U.S. PATENT DOCUMENTS

| | | | | |
|---|---|---|---|---|
| 4,017,580 | A | 4/1977 | Barbey | |
| 5,534,339 | A * | 7/1996 | Stokes | 442/361 |
| 5,783,503 | A * | 7/1998 | Gillespie et al. | 442/340 |
| 5,899,785 | A | 5/1999 | Groten et al. | |
| 6,100,208 | A | 8/2000 | Brown et al. | |
| 6,402,870 | B1 | 6/2002 | Groten et al. | |
| 2004/0222545 | A1 | 11/2004 | Reibel et al. | |

FOREIGN PATENT DOCUMENTS

| | | |
|---|---|---|
| CN | 1265435 | 9/2000 |
| DE | 60108762 | 1/2006 |
| DE | 69736011 | 11/2006 |
| EP | 1048771 | 11/2000 |
| EP | 0941379 | 9/2003 |
| EP | 1428919 | 6/2004 |
| FR | 2299438 | 8/1976 |
| JP | 1-97256 | 4/1989 |
| TW | 200424389 | 3/1993 |
| WO | 02/12604 | 2/2002 |
| WO | 2006/107695 | 10/2006 |

OTHER PUBLICATIONS

Tut, "Characteristiques des Fibres Chimiques a Usages Techniques", 1995, Les Editions de L'Industrie Textile, Paris. English translation attached.

Itf Lyon, "Caracteristiques Des Fibres Pour Habillement & Ameublement", 1987, Les Editions de L'Industrie Textile, Paris. English translation attached.

International Search Report from corresponding PCT Application No. PCT/EP2008/005391 dated Sep. 12, 2008.

Hanser Verlag, Saechtling, Kunststoff Taschenbuch [Plastic Handbook], 25th Edition, p. 212.

* cited by examiner

*Primary Examiner* — Jeff Aftergut

(74) *Attorney, Agent, or Firm* — Grossman, Tucker, Perreault & Pfleger, PLLC

(57) ABSTRACT

A method with which a textile sheet having good mechanical properties in respect to relatively high values regarding tear propagation resistance can be produced. The textile sheets are used in areas that require relatively high tear propagation resistance. The textile sheets also have relatively high peak tensile values and/or elongation at break values. The method for the production of a tear propagation-resistant textile sheet comprises providing a starting textile sheet made of yarns, fibers or filaments formed of at least two elementary filaments and having an arrangement in cross-section like orange segments or pie slices with the segments or slices made of different polymers, and exposing the starting textile sheet to a compressing heat treatment, wherein the polymer segments are permeated and a substantially non-adhesive bond is achieved between the polymer segments. The textile sheet may comprise nonwoven materials having a specific tear propagation resistance of equal to or greater than 0.4 N per g/m$^2$ (according to Zungen method, ASTM D 2261).

6 Claims, No Drawings

TEAR PROPAGATION-RESISTANT TEXTILE SHEET MATERIAL, METHOD MAKING AND USE THEREOF

CROSS-REFERENCE TO RELATED APPLICATIONS

This application claims the benefit of International Patent Application WO 2009/030300 (PCT/EP2008/005391), filed on Jul. 2, 2008 which claims the benefit of German Application DE 10 2007 040 795.7 filed on Aug. 28, 2007.

FIELD

The present invention relates to a method for the production of a tear propagation-resistant textile sheet made of yarns, fibers or filaments, which are formed from at least two elementary filaments from various polymers, to a tear propagation-resistant textile sheet material, and to the use thereof.

BACKGROUND

One method for the production of propagation tear-resistant nonwoven materials made of bicomponent fibers with an islands-in-the-sea configuration is known from the document WO 2006/107695A2 or US 2006/0223405A1. A nylon/polyethylene polymer pair described therein, having a weight ratio of 75:25 with various islands-in-the-sea configurations, has a maximum specific tear propagation resistance of 0.22 N per g/m$^2$ after calendaring.

The object of the present invention is to provide a method by which textile sheets may be produced with relatively good mechanical properties in terms of relatively high values with regard specifically to tear propagation resistance. The textile sheet of the invention are usable in areas that require relatively high tear propagation resistance of the textile sheet. Preferably, the textile sheet also has relatively high maximum tensile force values and/or elongation at break values.

SUMMARY

With respect to the method of the invention, a starting textile sheet material made of yarns, fibers or filaments formed from at least two elementary filaments which when viewed in cross-section, having an orange segment or pie configuration with segments made of different polymers is exposed to compression heat treatment, wherein the different polymer segments become permeated, and at least a substantially non-adhesive bond is achieved between segments.

In this context, a substantially non-adhesive bond between segments is one that has no adhesion, poor adhesion or only marginal adhesion. For instance, materials having marginal adhesion have a marginal or no diffusion bond, but under certain circumstances have a good adhesive bond, and materials having poor adhesion have no diffusion bond and a marginal adhesive bond, if any.

In the preferred embodiment of the method, a textile sheet having a specific tear propagation resistance of equal to or greater than 0.4 N per g/m$^2$, preferably of about 0.6 to 0.9 N per g/m$^2$ according to the tongue method of ASTM D 2261 is produced.

Advantageously, the textile sheet has a relatively low surface weight of about 20 to 500 g/m$^2$, preferably from about 40 to 300 g/m$^2$. The textile sheet is preferably a nonwoven material, which is at least partially formed from bicomponent continuous fibers or composite fibers. The fibers in this case preferably may have a total titer of about 1.6 dtex to 6.4 dtex, preferably of about 2 to 4.8 dtex.

The orange segment or pie configuration advantageously has 2, 4, 8, 16, 32 or 64 segments, preferably 8, 16 or 32 segments. Thermoplastic polymers, especially so-called incompatible polymer pairs or polymer blends made of different polyolefins with polyesters, polyamides and/or polyurethanes in any combination are preferably used, resulting in non-adhesive pairs.

The polymer pairs that are used are preferably chosen from among polymer pairs with at least one polyolefin, preferably including but not limited to polyethylene or polypropylene or polypropylene/polyethylene, such as polyamide6/polyethylene or polyethylene terephthalate/polyethylene, or polyamide6/polypropylene or polyethylene terephthalate/polypropylene.

Polymer pairs with at least one polyamide or with at least one polyethylene terephthalate are preferably used due to their marginal segment adhesion, and polymer pairs with at least one polyolefin are especially preferably used due to their poor adhesion.

Filaments including polyamide may have marginal adhesion between segments, especially a marginal diffusion bond, and a good adhesive bond. Filaments including polyethylene terephthalate may have marginal adhesion between segments, especially no diffusion bonding, and a good adhesive bonding only after pretreatment, for example with plasma. The polyolefins, polyethylene and polypropylene are poorly adhesive, especially when they have no diffusion bonding, and have marginal adhesive bonding only after pretreatment (HANSER Verlag, Saechtling, Kunststoff Taschenbuch [Plastics Handbook], 25$^{th}$ Edition, p. 212).

The polymer pairs are preferably used in a weight ratio of 90:10 to 10:90 of the higher melting polymer to the lower melting polymer of the different polymer pairs. Weight ratios of higher melting polymer to lower melting polymer of 75:25 to 70:30 have proven particularly advantageous.

Heat treatment may be performed in a calendar, in other words in a heated pair of rollers, at a temperature that is less than or equal to 100° C. above the melting temperature of the lower melting polymer component and at the same time is below the melting temperature of the higher melting polymer component.

In addition, the compression heat treatment may be preferably performed at a pressure of about 100 to 1000 N/linear cm of product width, preferably from about 300 to 700 N/linear cm of product width (textile sheet).

The invention further relates to a textile sheet, especially nonwovens, which has a specific tear propagation resistance of equal to or greater than 0.4 N per g/m$^2$, preferably of about 0.6 to 0.9 N per g/m$^2$, according to the tongue method of ASTM D 2261, and which may be produced via a compression heat treatment process, such as a calendar, wherein the textile sheet may be made of yarns, fibers or filaments, which are formed from at least two elementary filaments and which, when viewed in cross-section, have an orange-segment or pie configuration with segments made of different polymers, wherein the different polymer segments are permeated and have a substantially non-adhesive bond, in other words a bond achieved not with adhesive binding agents between the polymer segments.

The surface weight of the textile sheet may be about 20 to 500 g/m$^2$, preferably about 40 to 300 g/m$^2$.

The textile sheet may be partially formed from bicomponent continuous filaments or composite filaments. These yarns, fibers or filaments preferably have a total titer of about 1.6 dtex to 6.4 dtex, preferably of about 2 to 4.8 dtex.

The orange segment or pie configuration of the yarns, fibers or filaments preferably may have 2, 4, 8, 16, 32 or 64 segments, and preferably 8, 16 or 32 segments.

Thermoplastic polymers, especially so-called incompatible polymer pairs or polymer blends, made of different polyolefins in combination with polyesters, polyamides and/or polyurethanes in any combination are preferably used, wherein non-adhesive pairs result in the greatest tear propagation-resistance values.

The weight ratio of higher melting polymer to lower melting polymer in the polymer pairs is preferably about 90:10 to 10:90, preferably about 75:25 to 70:30.

The textile sheet of the present invention is intended especially for use in areas that require a relatively high tear propagation resistance of the textile sheet.

The textile sheet of the invention may be usable as coverings for vehicle components, especially for boat or truck tarpaulins, or for textile architecture, especially tents, convertible covers or inflatable structures, especially inflatable boats or mobile play structures.

DETAILED DESCRIPTION

The subject of the invention will be specified in greater detail in what follows within the context of examples.

In each case, a nonwoven textile sheet made of bicomponent continuous filaments comprised of the polymer pairs of polyamide6/polyethylene, polypropylene/polyethylene and polyethylene terephthalate/polyethylene are produced.

In these, the following materials are used:

Polyethylene terephthalate: INVISTA 8218J, 0.641.V.

Polyamide 6: BASF B2702

Polypropylene: SUNOCO CP360-H

Polyethylene: DOW XUS 61800.50

For the exemplary embodiments of the invention, the following process parameters are chosen:

| Type | Polyamide 6/ Polyethylene | Polypropylene/ Polyethylene | Polyethylene terephthalate/ Polyethylene |
|---|---|---|---|
| Extrusion temperatures | 255° C./ 227° C. | 288° C./ 227° C. | 295° C./ 227° C. |
| Spinning speed | 5500 m/min | 5500 m/min | 5500 m/min |
| Pie configuration | 16 segments | 16 segments | 16 segments |
| Weight ratio | 75/25 | 75/25 | 75/25 |

For the comparison examples, the following process parameters are chosen:

| Type | Polyamide 6/ Polyethylene | Polypropylene/ Polyethylene | Polyethylene terephthalate/ Polyethylene |
|---|---|---|---|
| Extrusion temperatures | 255° C./ 227° C. | 288° C./ 227° C. | 295° C./ 227° C. |
| Spinning speed | 5500 m/min | 5500 m/min | 5500 m/min |
| Islands-in-the-sea configuration | 7, 19 and 108 | 7, 19 and 108 | 7, 19 and 108 |
| Weight ratio | 75/25 | 75/25 | 75/25 |

The production process is similar with respect to cooling, drawing and web forming conditions to the process described in the French patent specification FR 2 299 438.

In each case, nonwoven materials having a surface weight of about 100 g/m$^2$ (Tables 1, 3 and 5) and about 150 g/m$^2$ (Tables 2, 4 and 6) are produced, which as starting nonwoven materials are subjected to compression heat treatment in a calendar at a temperature of 140° C., 145° C. or 150° C. and a pressure of 100 to 1000 N/linear cm of product width, preferably of 300 to 700 N/linear cm of product width. The calendaring speed is 5 to 20 m/min, preferably 8 to 12 m/min, and the roller diameter is 320 to 489 mm.

The nonwoven materials produced according to the invention in pie slice configuration (PIE) possess relatively good mechanical properties in terms of relatively high values for tear propagation resistance, maximum tensile force and/or elongation at break, especially as compared with nonwoven materials in an islands-in-the-sea (INS) configuration (see Tables 1-6).

The surprisingly high tear propagation force resistance values were not expected on the basis of adhesion and textile mechanics, since polymer pairs made of non-adhesive, only poorly or marginally adhesive polymer components may have high tear propagation resistance values such as these.

Of all the nonwoven materials tested under Tables 1 through 6, the highest maximum tensile force values are found in the nonwoven materials produced according to the invention and having a surface weight of approximately 100 g/m$^2$ in pie slice configuration with the polymer pairs comprising alternating segments of polyamide 6 and polyethylene at a calendaring temperature of 150° C., and polyethylene terephthalate and polyethylene at a calendaring temperature of 140° C. (See Table 1, PIE 16, MTF lengthwise).

For nonwoven materials produced according to the invention and having a surface weight of approx. 150 g/m$^2$ in pie slice configuration the highest maximum tensile force values are found with the polymer pair comprising alternating segments of polyethylene terephthalate and polyethylene at a calendaring temperature of 145° C. (See Table 6, PIE 16, MTF lengthwise)

The highest tear propagation resistance values of all tested nonwoven materials according to Tables 1 through 6 are exhibited by the nonwoven materials produced according to the invention and having a surface weight of approx. 150 g/m$^2$ in pie slice configuration with the polymer pair comprising alternating segments of polyamide 6 and polyethylene at calendaring temperatures of 150° C. and 140° C. (See Table 2, PIE 16, TPR lengthwise)

Table 1 shows that after treatment at calendaring temperatures of 140° C., 145° C. and 150° C. the nonwoven materials with the polymer pair comprising polyamide 6/polyethylene and a surface weight of approx. 100 g/m$^2$ in pie slice configuration (PIE) have significantly higher maximum tensile force values than the corresponding nonwoven materials in islands-in-the-sea configurations (with the exception of the islands-in-the-sea configuration (INS) with 108 islands at 145° C.).

Table 1 also shows that, after treatment at a calendaring temperature of 150° C., the nonwoven materials with the polymer pair comprising polyamide 6/polyethylene and a surface weight of approx. 100 g/m$^2$ in pie slice configuration (PIE) have higher elongation at break values than the corresponding nonwoven materials in islands-in-the-sea configurations (INS).

Table 2 shows that, after treatment at calendaring temperatures of 140° C., 145° C. and 150° C., the nonwoven materials with the polymer pair comprising polyamide 6/polyethylene and a surface weight of approx. 150 g/m$^2$ in pie slice configuration (PIE) have significantly higher tear propagation resistance values than the corresponding nonwoven materials in islands-in-the-sea configurations (INS).

Table 2 also shows that, after treatment at a calendaring temperature of 150° C., the nonwoven materials with the polymer pair comprising polyamide 6/polyethylene and a surface weight of approx. 150 g/m$^2$ in pie slice configuration (PIE) have significantly higher maximum tensile force values and elongation at break values than the corresponding nonwoven materials in islands-in-the-sea configurations (INS).

Table 3 shows that, after treatment at calendaring temperatures of 140° C., 145° C. and 150° C., the nonwoven materials with the polymer pair comprising polypropylene/polyethylene and a surface weight of approx. 100 g/m$^2$ in pie slice configuration (PIE) have significantly higher elongation at break values than the corresponding nonwoven materials in islands-in-the-sea configurations (INS).

Table 3 also shows that, after treatment at calendaring temperatures of 145° C. and 150° C., the nonwoven materials with the polymer pair comprising polypropylene/polyethylene and a surface weight of approx. 100 g/m$^2$ in pie slice configuration (PIE) have significantly higher maximum tensile force values than the corresponding nonwoven materials in islands-in-the-sea configurations (INS).

Table 4 shows that after treatment, the nonwoven materials with the polymer pair comprising polypropylene/polyethylene and a surface weight of approx. 150 g/m$^2$ in pie slice configuration (PIE) have significantly higher maximum tensile force values and elongation at break values than the corresponding nonwoven materials in islands-in-the-sea configurations (INS).

Table 5 shows that, after treatment at calendaring temperatures of 140° C., 145° C. and 150° C., the nonwoven materials with the polymer pair comprising polyethylene terephthalate/polyethylene and a surface weight of approx. 100 g/m$^2$ in pie slice configuration (PIE) have significantly higher elongation at break values and tear propagation resistance values than the corresponding nonwoven materials in islands-in-the-sea configurations (INS).

Table 5 also shows that, after treatment at a calendaring temperature of 140° C., the nonwoven materials with the polymer pair comprising polyethylene terephthalate/polyethylene and a surface weight of approx. 100 g/m$^2$ in pie slice configuration (PIE) have higher maximum tensile force values than the corresponding nonwoven materials in islands-in-the-sea configurations (INS).

Table 6 shows that, after treatment at calendaring temperatures of 140° C., 145° C. and 150° C., the nonwoven materials with the polymer pair comprising polyethylene terephthalate/polyethylene and a surface weight of approx. 150 g/m$^2$ in pie slice configuration (PIE) have significantly higher elongation at break values than the corresponding nonwoven materials in islands-in-the-sea configurations (INS).

Table 6 also shows that, after treatment at calendaring temperatures of 140° C. and 145° C., the nonwoven materials with the polymer pair comprising polyethylene terephthalate/polyethylene and a surface weight of approx. 150 g/m$^2$ in pie slice configuration (PIE) have higher maximum tensile force values than the corresponding nonwoven materials in islands-in-the-sea configurations (INS).

Comparative tests using nonwoven materials in pie slice configuration with 8 segments suggest that the number of segments, i.e., whether 8, 16, 32 or 64 segments are present, plays a subordinate role, and does not significantly affect the aforementioned mechanical properties of the nonwoven materials.

In addition, comparative tests involving a nonwoven material having a surface weight of 100 g/m$^2$ with the polymer pair comprising polyamide 6/polyethylene in pie slice configuration with 8, 16 or 32 segments, calendared at temperatures above the melting temperature of polyethylene, and in each case a nonwoven material with the polymer pair comprising polyethylene terephthalate/polyamide 6 in islands-in-the-sea configurations with 7, 19 or 108 islands, also calendared, have shown that the nonwoven materials with the polymer pair comprising polyamide 6/polyethylene in pie slice configuration have a specific tear propagation resistance according to the tongue method of ASTM D 2261 of greater than 0.4 N per g/m$^2$, as compared with 0.04 to 0.08 N per g/m$^2$ in nonwoven materials with the polymer pair polyethylene terephthalate/polyamide 6 in islands-in-the-sea configurations.

Comparative testing of a nonwoven material with the polymer pair comprising polyethylene terephthalate/polyethylene in pie slice configuration with 8, 16 and 32 segments, calendared at temperatures above the melting temperature of polyethylene,—with a nonwoven material with the polymer pair comprising polyamide/polyethylene in pie slice configuration with 8, 16 and 32 segments, calendared at temperatures above the melting temperature of polyethylene, each as compared with a nonwoven material with the polymer pair comprising polyethylene terephthalate/polyamide 6 in pie slice configuration with 16 segments after water jet solidification according to DE 697 25 051 T2, show an improved tear propagation resistance by a factor of approximately 3 to 10.5, as is shown by way of example in Table 7 for the listed polymer pairs in pie slice configuration with 16 segments.

A comparison of tensile strengths and/or break resistances of the involved polymers alone shows that a deduction of the tear propagation resistance values, which are improved by up to a factor of 10.5 according to Table 7, could not be expected.

TABLE 1

PA6/PE (75/25), approx. 100 g/m$^2$ with various configurations at various calendar temperatures

| | Configuration | | | | | | | | | | | |
|---|---|---|---|---|---|---|---|---|---|---|---|---|
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 118.1 | 103 | 106.6 | 97.9 | 106.3 | 103.4 | 105.1 | 110.2 | 101 | 102.1 | 104.9 | 99.1 |
| MTF lengthwise N/5 cm | 357.7 | 393.5 | 345.3 | 406.9 | 359.2 | 508.8 | 360.9 | 432.9 | 403.7 | 494.1 | 397.4 | 498.2 |
| MTF crosswise, N/5 cm | 190.6 | 192.7 | 170.6 | 212.8 | 193.4 | 194.5 | 177.3 | 225.1 | 215.4 | 185.5 | 178.2 | 268 |
| MTF (l + c)/2, N/5 cm | 274.2 | 293.1 | 258.0 | 309.9 | 276.3 | 351.7 | 269.1 | 329.0 | 309.6 | 339.8 | 287.8 | 383.1 |
| Isotropy | 1.88 | 2.04 | 2.02 | 1.91 | 1.86 | 2.62 | 2.04 | 1.92 | 1.87 | 2.66 | 2.23 | 1.86 |
| EB lengthwise, % | 41.8 | 56 | 48.2 | 42.9 | 45.9 | 52.5 | 43.4 | 47.1 | 45.1 | 57.6 | 41.1 | 52.7 |
| EB crosswise, % | 68.9 | 66.2 | 61.3 | 63.3 | 59.4 | 71.1 | 62.7 | 65.7 | 62.9 | 65.3 | 56.9 | 75.6 |
| EB (l + w)/2, % | 55.4 | 61.1 | 54.8 | 53.1 | 52.7 | 61.8 | 53.1 | 56.4 | 54.0 | 61.5 | 49.0 | 64.2 |
| TPR lengthwise, N | 48.4 | 83.6 | 47.7 | 53.4 | 64.6 | 51.5 | 52.4 | 52.9 | 56.7 | 51 | 51.3 | 51.6 |

TABLE 1-continued

| PA6/PE (75/25), approx. 100 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| TPR crosswise, N | 81.8 | 97.2 | 96.3 | 91.5 | 69.6 | 88.6 | 82.3 | 83 | 68.9 | 84.1 | 97 | 75.5 |
| TPR (l + w)/2, N | 65.1 | 90.4 | 72.0 | 72.5 | 67.1 | 70.1 | 67.4 | 68.0 | 62.8 | 67.6 | 74.2 | 63.6 |
| TPR (l + w)/2: SW, N per g/m$^2$ | 0.551 | 0.878 | 0.675 | 0.741 | 0.631 | 0.678 | 0.641 | 0.617 | 0.621 | 0.662 | 0.707 | 0.641 |

PA6/PE: Polyamide 6/polyethylene;
INS = Islands in the sea configuration;
PIE = pie slice configuration;
Calendar-T = Calendar; temperature;
SW = surface weight;
MTF = maximum tensile force (DIN 29073);
EB = elongation at break (DIN 29073);
TPR = tear propagation resistance (ASTM D 2261, tongue method)

TABLE 2

| PA6/PE (75/25), approx. 150 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 159.1 | 159.5 | 160 | 148.6 | 160.5 | 154.1 | 168.4 | 153 | 160 | 163 | 164.1 | 143.5 |
| MTF lengthwise, N/5 cm | 412.9 | 541.4 | 419.5 | 462.7 | 451.9 | 605.2 | 466.2 | 517.2 | 485.6 | 548.9 | 469.5 | 560.7 |
| MTF crosswise, N/5 cm | 146.8 | 247 | 235 | 297.5 | 270.3 | 252.5 | 249.6 | 309.7 | 279.4 | 132.5 | 254.8 | 368.7 |
| MTF (l + c)/2, N/5 cm | 279.9 | 394.2 | 327.3 | 380.1 | 361.1 | 428.9 | 357.9 | 413.5 | 382.5 | 340.7 | 362.2 | 464.7 |
| Isotropy | 2.81 | 2.19 | 1.79 | 1.56 | 1.67 | 2.40 | 1.87 | 1.67 | 1.74 | 4.14 | 1.84 | 1.52 |
| EB lengthwise, % | 39.7 | 46.5 | 43.9 | 38.9 | 40.5 | 50.1 | 44.2 | 39.3 | 41.1 | 41.8 | 41.1 | 42.2 |
| EB crosswise, % | 32.9 | 62.5 | 58.5 | 65.4 | 69.7 | 67.2 | 65.1 | 66.5 | 68.1 | 24.2 | 64.6 | 80.3 |
| EB (l + w)/2, % | 36.3 | 54.5 | 51.2 | 52.2 | 55.1 | 58.7 | 54.7 | 52.9 | 54.6 | 33.0 | 52.9 | 61.3 |
| TPR lengthwise, N | 73.2 | 77.1 | 106.2 | 108.4 | 65.1 | 69.3 | 69.9 | 82.2 | 58.8 | 74.2 | 74.6 | 108.1 |
| TPR crosswise, N | 106.2 | 132.6 | 113 | 125.6 | 122.4 | 135.8 | 132.8 | 127.3 | 127.4 | 129.4 | 114.4 | 133 |
| TPR (l + w)/2, N | 89.7 | 104.9 | 109.6 | 117.0 | 93.8 | 102.6 | 101.4 | 104.8 | 93.1 | 101.8 | 94.5 | 120.6 |
| TPR (l + w)/2: SW, N per g/m$^2$ | 0.564 | 0.658 | 0.685 | 0.787 | 0.584 | 0.666 | 0.602 | 0.685 | 0.582 | 0.625 | 0.576 | 0.840 |

PA6/PE: Polyamide 6/polyethylene;
INS = Islands in the sea configuration;
PIE = pie slice configuration;
Calendar-T = Calendar temperature;
SW = surface weight;
MTF = maximum tensile force (DIN 29073);
EB = elongation at break (DIN 29073);
TPR = tear propagation resistance (ASTM D 2261, tongue method)

TABLE 3

| PP/PE (75/25), approx. 100 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 110.2 | 105.8 | 102 | 100.4 | | 106.8 | 103.9 | 100.5 | | 106 | 103.9 | 100.5 |
| MTF lengthwise, N/5 cm | 255.5 | 197.2 | 182.6 | 212.6 | | 254.8 | 204 | 253 | | 294.7 | 290 | 273.8 |
| MTF crosswise, N/5 cm | 146.2 | 107.1 | 131.7 | 139.4 | | 118.8 | 124.6 | 148.8 | | 131.3 | 126.1 | 153.6 |
| MTF (l + c)/2, N/5 cm | 200.85 | 152.15 | 157.2 | 176 | | 186.8 | 164.3 | 200.9 | | 213 | 208.1 | 213.7 |

TABLE 3-continued

| PP/PE (75/25), approx. 100 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Isotropy | 1.75 | 1.84 | 1.39 | 1.53 | | 2.14 | 1.64 | 1.70 | | 2.24 | 2.30 | 1.78 |
| EB lengthwise, % | 33.9 | 30.6 | 31.2 | 36.9 | | 30.3 | 30.8 | 45.1 | | 30.5 | 42.8 | 31.5 |
| EB crosswise, % | 57.8 | 45.6 | 54.3 | 65.3 | | 46.7 | 49.6 | 62 | | 44.1 | 43.2 | 61.4 |
| EB (l + w)/2, % | 45.9 | 38.1 | 42.8 | 51.1 | | 38.5 | 40.2 | 53.6 | | 37.3 | 43.0 | 46.5 |
| TPR lengthwise, N | 43.6 | 59.3 | 59.9 | 30.9 | | 28.3 | 31.7 | 27.9 | | 20.9 | 20.1 | 25.8 |
| TPR crosswise, N | 46.6 | 41.1 | | | | 57.2 | 29.3 | 34.4 | | 37.7 | 29.1 | 22.3 |
| TPR (l + w)/2, N | 45.1 | 50.2 | | | | 42.8 | 30.5 | 31.2 | | 29.3 | 24.6 | 24.1 |
| TPR (l + w)/2: SW, N per g/m$^2$ | 0.409 | 0.474 | | | | 0.401 | 0.294 | 0.310 | | 0.276 | 0.237 | 0.240 |

PP/PE: Polypropylene/polyethylene;
INS = Islands in the sea configuration;
PIE = pie slice configuration
Calendar-T = Calendar temperature;
SW = surface weight;
MTF = maximum tensile force (DIN 29073);
EB = elongation at break (DIN 29073);
TPR = tear propagation resistance (ASTM D 2261, tongue method)

TABLE 4

| PP/PE (75/25), approx. 150 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 165.4 | 152.5 | 165.7 | 154.3 | | 161.1 | 168.1 | 166.1 | | 161.3 | 167.5 | 157.4 |
| MTF lengthwise, N/5 cm | 315 | 314 | 291.2 | 342 | | 313.4 | 303.1 | 332.2 | | 324.8 | 336.9 | 369.4 |
| MTF crosswise, N/5 cm | 177.6 | 157.6 | 171 | 226.7 | | 155.6 | 180.5 | 229.7 | | 170.3 | 202.5 | 240.2 |
| MTF (l + c)/2, N/5 cm | 246.3 | 235.8 | 231.1 | 284.4 | | 234.5 | 241.8 | 281.0 | | 247.6 | 269.7 | 304.8 |
| Isotropy | 1.77 | 1.99 | 1.70 | 1.51 | | 2.01 | 1.68 | 1.45 | | 1.91 | 1.66 | 1.54 |
| EB lengthwise, % | 33.8 | 29.9 | 33 | 43.5 | | 23.3 | 33 | 39.5 | | 24 | 34.6 | 38.4 |
| EB crosswise, % | 63.7 | 52.7 | 49.1 | 84 | | 50.1 | 46.6 | 80.2 | | 44.2 | 53.6 | 72.8 |
| EB (l + w)/2, % | 48.8 | 41.3 | 41.1 | 63.8 | | 36.7 | 39.8 | 59.9 | | 34.1 | 44.1 | 55.6 |
| TPR lengthwise, N | 77.2 | 89.8 | 70.6 | 94.1 | | 57.9 | 68.6 | 79.6 | | 51 | 52.6 | 75.2 |
| TPR crosswise, N | 130.5 | 121.5 | 123.3 | 105.4 | | 124.2 | 132 | 96.5 | | 126.1 | 113.5 | 81.4 |
| TPR (l + w)/2, N | 103.9 | 105.7 | 97.0 | 99.8 | | 91.1 | 100.3 | 88.1 | | 88.6 | 83.1 | 78.3 |
| TPR (l + w)/2: SW, N per g/m$^2$ | 0.628 | 0.693 | 0.585 | 0.647 | | 0.565 | 0.597 | 0.530 | | 0.549 | 0.496 | 0.497 |

PP/PE: Polypropylene/polyethylene;
INS = Islands in the sea configuration;
PIE = pie slice configuration
Calendar-T = Calendar temperature;
SW = surface weight;
MTF = maximum tensile force (DIN 29073);
EB = elongation at break (DIN 29073);
TPR = tear propagation resistance (ASTM D 2261, tongue method)

TABLE 5

| PET/PE (75/25), approx. 100 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 99.8 | | 98.9 | 104.9 | 112 | | 99.5 | 99.8 | 105 | | 100.1 | 106.6 |
| MTF lengthwise, | 400.1 | | 262.9 | 496.1 | 447.3 | | 215.5 | 400.3 | 470.4 | | 180.6 | 341.9 |

TABLE 5-continued

| PET/PE (75/25), approx. 100 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| N/5 cm | | | | | | | | | | | | |
| MTF crosswise, N/5 cm | 193.5 | | 165.8 | 226.9 | 204.6 | | 172.9 | 232.6 | 192 | | 165.9 | 234.1 |
| MTF (l + c)/2, N/5 cm | 296.8 | | 214.4 | 361.5 | 326.0 | | 194.2 | 316.5 | 331.2 | | 173.3 | 288.0 |
| Isotropy | 2.07 | | 1.59 | 2.19 | 2.19 | | 1.25 | 1.72 | 2.45 | | 1.09 | 1.46 |
| EB lengthwise, % | 40.4 | | 54.6 | 58.5 | 43.7 | | 42.7 | 49.8 | 48.3 | | 33.1 | 48.7 |
| EB crosswise, % | 46.1 | | 55.2 | 54.5 | 48.4 | | 61.6 | 57.5 | 49.6 | | 57 | 57.1 |
| EB (l + w)/2, % | 43.3 | | 54.9 | 56.5 | 46.1 | | 52.2 | 53.7 | 49.0 | | 45.1 | 52.9 |
| TPR lengthwise, N | 30.4 | | 29.1 | 35.2 | 32.1 | | 27.8 | 42 | 29.5 | | 25.1 | 49.1 |
| TPR crosswise, N | 37.1 | | 30.7 | 58.9 | 37.3 | | 33.1 | 36 | 41.6 | | 35.3 | 36.8 |
| TPR (l + w)/2, N | 33.8 | | 29.9 | 47.1 | 34.7 | | 30.5 | 39.0 | 35.6 | | 30.2 | 43.0 |
| TPR (l + w)/2: SW, N per g/m$^2$ | 0.339 | | 0.302 | 0.449 | 0.310 | | 0.307 | 0.391 | 0.339 | | 0.302 | 0.403 |

PET/PE: Polyethylene terephthalate/polyethylene;
INS = Islands in the sea configuration;
PIE = pie slice configuration
Calendar-T = Calendar temperature;
SW = surface weight;
MTF = maximum tensile force (DIN 29073);
EB = elongation at break (DIN 29073);
TPR = tear propagation resistance (ASTM D 2261, tongue method)

TABLE 6

| PET/PE (75/25), approx. 150 g/m$^2$ with various configurations at various calendar temperatures | | | | | | | | | | | | |
|---|---|---|---|---|---|---|---|---|---|---|---|---|
| | Configuration | | | | | | | | | | | |
| | INS 7 | INS 108 | INS 19 | PIE 16 | INS 7 | INS 108 | INS 19 | PIE 16 | INS 7 | INS 108 | INS 19 | PIE 16 |
| Calendar-T, ° C. | 140° C. | 140° C. | 140° C. | 140° C. | 145° C. | 145° C. | 145° C. | 145° C. | 150° C. | 150° C. | 150° C. | 150° C. |
| SW, g/m$^2$ | 140.6 | | 153.1 | 151.1 | 148.3 | | 155.3 | 149.2 | 153.9 | | 149.4 | 153.5 |
| MTF lengthwise, N/5 cm | 553.2 | | 283.7 | 606.2 | 623.8 | | 315.2 | 680.8 | 686.2 | | 309.8 | 603.6 |
| MTF crosswise, N/5 cm | 238.2 | | 263.7 | 337.1 | 317.6 | | 282.8 | 365.6 | 322 | | 293.5 | 367.5 |
| MTF (l + c)/2, N/5 cm | 395.7 | | 273.7 | 471.7 | 470.7 | | 299.0 | 523.2 | 504.1 | | 301.7 | 485.6 |
| Isotropy | 2.32 | | 1.08 | 1.80 | 1.96 | | 1.11 | 1.86 | 2.13 | | 1.06 | 1.64 |
| EB lengthwise, % | 38.5 | | 40.9 | 48.9 | 47.7 | | 44.8 | 60.9 | 52.5 | | 41.1 | 53 |
| EB crosswise, % | 50.4 | | 66.5 | 60.2 | 55.3 | | 66.7 | 64.7 | 61 | | 69.3 | 63.4 |
| EB (l + w)/2, % | 44.5 | | 53.7 | 54.6 | 51.5 | | 55.8 | 62.8 | 56.8 | | 55.2 | 58.2 |
| TPR lengthwise, N | 78.7 | | 34.5 | 68.9 | 71.5 | | 42.7 | 65.1 | 62.4 | | 52.2 | 87.3 |
| TPR crosswise, N | 102.9 | | | 91.9 | 95.4 | | 64.9 | 77.7 | 91.9 | | 59.8 | 63.2 |
| TPR (l + w)/2, N | 90.8 | | | 80.4 | 83.5 | | 53.8 | 71.4 | 77.2 | | 56.0 | 75.3 |
| TPR (l + w)/2: SW, N per g/m$^2$ | 0.646 | | | 0.532 | 0.563 | | 0.346 | 0.479 | 0.502 | | 0.375 | 0.491 |

PET/PE: Polyethylene terephthalate/polyethylene;
INS = Islands in the sea configuration;
PIE = pie slice configuration
Calendar-T = Calendar temperature;
SW = surface weight;
MTF = maximum tensile force (DIN 29073);
EB = elongation at break (DIN 29073);
TPR = tear propagation resistance (ASTM D 2261, tongue method)

TABLE 7

| Various polymer pairs in pie slice configuration 16 after various processing treatments | | | |
|---|---|---|---|
| Polymer Pair | PET/PA6 (75/25) | PET/PE (75/25) | PET/PA6 (75/25) |
| Treatment | Water jet solidification according to DE 697 25 051 T2 | Calendar (see Tablesv 5 and 6) | Calendar (see Tables 1 and 2) |

TABLE 7-continued

| Various polymer pairs in pie slice configuration 16 after various processing treatments | | | |
|---|---|---|---|
| Polymer Pair | PET/PA6 (75/25) | PET/PE (75/25) | PET/PA6 (75/25) |
| TPR (l + w)/2: SWN per g/m$^2$ | Approx. 0.08 up to 0.16 | Up to 0.532 | Up to 0.840 |

TPR = Tear propagation resistance (ASTM D 2261, tongue method)

TABLE 7-continued

| Various polymer pairs in pie slice configuration 16 after various processing treatments | | | |
|---|---|---|---|
| Polymer Pair | PET/PA6 (75/25) | PET/PE (75/25) | PET/PA6 (75/25) |

PET/PA6: Polyethylene terephthalate/polyamide 6
PET/PE: Polyethylene terephthalate/polyethylene
PA6/PE: Polyamide/polyethylene

| Standard Filaments | PET | PA6 | PE |
|---|---|---|---|
| Tensile strength, N/tex | 0.37 to 0.5 | 0.4 to 0.62 | 0.5 |
| Break resistance, MPa | 510 to 690 | 450 to 700 | 475 |

Values from fiber tables from the Textiles Usages Techniques (TUT, "Characteristiques des Fibres Chimiques à Usages Techniques", 1995, Les Editions de L'Industrie Textile, Paris, ISBN: 2.907151.05.3).

What is claimed is:

1. A method for the production of a tear propagation-resistant textile sheet comprising:

providing a textile sheet made of yarns, fibers or filaments, which are formed from at least two elementary filaments which, when viewed in cross-section, have an orange segment or pie slice configuration with alternating first and second polymer segments comprising at least one polymer pair, wherein said first polymer segments comprise a first polymer of said polymer pair and said second polymer segments comprise a second polymer of said polymer pair that is different from said first polymer; and subjecting said textile sheet to a compression heat treatment, wherein at least a portion of said first polymer segments melt and permeate at least a portion of said second polymer segments so as to form a substantially non-adhesive bond between the first and second polymer segments without the use of an adhesive binding agent between said polymer segments and said sheet has a surface weight of 20 to 500 g/m$^2$;

wherein said polymer pair is selected from the group consisting of:

polypropylene/polyethylene, polyamide 6/polyethylene, polyethylene terephthalate/polyethylene, polyamide 6/polypropylene, polyethylene terephthalate/polypropylene, and combinations thereof and wherein said polymer pair comprise a higher melting polymer and a lower melting polymer and said polymer pairs have a weight ratio of higher melting polymer to lower melting polymer of 75:25 to 70:30.

2. The method according to claim 1 wherein said textile sheet has a specific tear propagation resistance of equal to or greater than 0.4 N per g/m$^2$ (tongue method, ASTM D 2261).

3. The method according to claim 1 wherein said textile sheet comprises a nonwoven material, at least partially formed from bicomponent continuous filaments, composite filaments, or fibers.

4. The method according to claim 1 wherein said orange segment or pie slice configuration has 2, 4, 8, 16, 32 or 64 segments.

5. The method according to claim 1, wherein said compression heat treatment is performed in a calendar at a temperature that is less than or equal to 100° C. above the melting temperature of the lower melting polymer and below the melting temperature of the higher melting polymer.

6. The method according to claim 1, wherein said compression heat treatment is performed at a pressure of 100 to 1000 N/linear cm of product width.

* * * * *